US009205009B2

(12) United States Patent
Koors et al.

(10) Patent No.: US 9,205,009 B2
(45) Date of Patent: Dec. 8, 2015

(54) PATIENT SUPPORT APPARATUS HAVING MOVABLE HANDLES

(71) Applicant: Hill-Rom Services, Inc., Batesville, IN (US)

(72) Inventors: Edward J. Koors, Indianapolis, IN (US); Joshua W. Shenk, Batesville, IN (US); Brian P. Michael, Greenfield, IN (US); Brian S. Guthrie, Greenwood, IN (US); Michael P. Bish, Lawrenceburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/098,749

(22) Filed: Dec. 6, 2013

(65) Prior Publication Data

US 2014/0165290 A1 Jun. 19, 2014

Related U.S. Application Data

(60) Provisional application No. 61/737,944, filed on Dec. 17, 2012.

(51) Int. Cl.

| | |
|---|---|
| ***A61G 7/012*** | (2006.01) |
| ***A61G 1/048*** | (2006.01) |
| ***A61G 7/08*** | (2006.01) |

(Continued)

(52) U.S. Cl.

CPC ..... *A61G 7/012* (2013.01); *A61G 1/048* (2013.01); *A61G 7/08* (2013.01); *A61G 7/018* (2013.01); *A61G 2007/0509* (2013.01); *A61G 2007/0524* (2013.01); *A61G 2007/0528* (2013.01); *A61G 2203/16* (2013.01); *A61G 2203/20* (2013.01); *A61G 2203/40* (2013.01); *A61G 2205/60* (2013.01)

(58) Field of Classification Search

CPC ..... A61G 7/012; A61G 7/018; A61G 7/05; A61G 2007/0524; A61G 2007/0528; A61G 1/0287; A61G 1/048; A61G 1/0281; A61G 2203/16; A61G 2203/20; A61G 2203/22; A61G 2203/70; A61G 13/104; A61G 7/08; A61G 2203/40; A61G 2007/0509; A61G 2205/60; B62B 3/02

USPC ..... 5/11, 425, 428, 510, 600, 611, 616, 732

See application file for complete search history.

(56) References Cited

U.S. PATENT DOCUMENTS

| | | | |
|---|---|---|---|
| 421,656 | A | 2/1890 | Blanken |
| 1,778,698 | A | 10/1930 | Joseph |
| 2,585,660 | A | 2/1952 | Kjos et al. |

(Continued)

FOREIGN PATENT DOCUMENTS

| | | | |
|---|---|---|---|
| EP | 1693037 | A1 | 8/2006 |
| EP | 1816994 | A1 | 8/2007 |

(Continued)

*Primary Examiner* — Nicholas Polito
*Assistant Examiner* — David R Hare
(74) *Attorney, Agent, or Firm* — Barnes & Thornburg LLP

(57) ABSTRACT

A patient support apparatus includes a rolling base, a push handle unit, and a siderail. The push handle unit is coupled to a head end of the rolling base to provide a hand hold for a user pushing the rolling base from along the head end of the rolling base. The siderail is extends along a side of the rolling base to provide a hand hold for a caregiver pushing the rolling base from along the side of the rolling base.

23 Claims, 5 Drawing Sheets

(51) Int. Cl.
*A61G 7/018* (2006.01)
*A61G 7/05* (2006.01)

(56) References Cited

U.S. PATENT DOCUMENTS 2,722,017 A 11/1955 Burst et al.
2,817,854 A 12/1957 Pratt
2,817,855 A 12/1957 Pratt
3,021,534 A 2/1962 Hausted
3,048,857 A 8/1962 Hutt
3,055,020 A 9/1962 Nelson
3,179,957 A 4/1965 Norton
3,220,024 A 11/1965 Nelson
3,249,387 A 5/1966 Pivacek
3,286,283 A 11/1966 Bertoldo
3,290,701 A 12/1966 Luff
3,312,986 A 4/1967 Fahrni et al.
3,318,596 A 5/1967 Herzog
3,344,445 A 10/1967 Crawford
3,351,962 A 11/1967 Dodrill et al.
3,486,176 A 12/1969 Murcott
3,585,659 A 6/1971 Burst et al.
3,614,795 A 10/1971 Agnew
3,747,133 A 7/1973 Hutt
3,865,434 A 2/1975 Sully
3,932,903 A 1/1976 Adams et al.
3,971,083 A 7/1976 Peterson
4,002,330 A 1/1977 Johansson
4,120,530 A 10/1978 Imbro
4,221,370 A 9/1980 Redwine
4,277,100 A 7/1981 Beougher
4,332,042 A 6/1982 Koncelik
4,417,361 A 11/1983 Smith
4,426,071 A 1/1984 Klevstad
4,439,880 A 4/1984 Koncelik et al.
4,541,622 A 9/1985 Tabuchi
4,612,679 A 9/1986 Mitchell
4,626,016 A 12/1986 Bergsten
4,680,790 A 7/1987 Packard et al.
4,703,975 A 11/1987 Roberts et al.
4,715,592 A 12/1987 Lewis
4,747,171 A 5/1988 Einsele et al.
4,839,933 A 6/1989 Plewright et al.
4,932,090 A 6/1990 Johansson
4,959,878 A 10/1990 Essek
4,993,089 A 2/1991 Solomon et al.
5,038,430 A 8/1991 Bly
5,060,327 A 10/1991 Celestina et al.
5,069,465 A 12/1991 Stryker et al.
5,083,430 A 1/1992 Hirata et al.
5,084,925 A 2/1992 Cook
5,195,200 A 3/1993 Leoutsakos
D336,578 S 6/1993 Celestina
5,216,768 A 6/1993 Bodine et al.
5,225,403 A 7/1993 Treiber et al.
5,231,721 A 8/1993 Fish
5,255,403 A 10/1993 Ortiz
5,331,698 A 7/1994 Newkirk et al.
5,335,385 A 8/1994 Brown
5,337,430 A 8/1994 Schlein
5,347,682 A 9/1994 Edgerton, Jr.
5,381,571 A 1/1995 Gabhart
5,384,927 A 1/1995 Mardero et al.
5,388,294 A * 2/1995 Reeder ..... 5/600
5,394,581 A 3/1995 Leoutsakos
5,418,988 A 5/1995 Iura
5,433,235 A 7/1995 Miric et al.
5,463,784 A 11/1995 Alpern
5,471,689 A 12/1995 Shaw et al.
5,485,699 A 1/1996 Gabhart
5,542,136 A 8/1996 Tappel
5,542,138 A 8/1996 Williams et al.
5,586,352 A 12/1996 O'Brien et al.
5,640,726 A 6/1997 Fichner Rathus
5,678,267 A 10/1997 Kinder
5,689,839 A 11/1997 Laganiere et al.
5,781,945 A 7/1998 Scherer et al.
5,787,530 A 8/1998 Brix
5,802,636 A 9/1998 Corbin et al.
5,806,111 A * 9/1998 Heimbrock et al. ..... 5/86.1
5,832,549 A 11/1998 Le Pallec et al.
5,836,026 A 11/1998 Reed
5,878,452 A 3/1999 Brooke et al.
6,058,531 A 5/2000 Carroll
6,076,209 A 6/2000 Paul
6,101,678 A 8/2000 Malloy et al.
6,185,767 B1 2/2001 Brooke et al.
6,240,583 B1 6/2001 Brooke et al.
D458,481 S 6/2002 Brooke
D459,119 S 6/2002 Brooke
6,397,416 B2 6/2002 Brooke et al.
6,401,280 B1 6/2002 Baker
6,427,264 B1 8/2002 Metz et al.
6,668,402 B2 * 12/2003 Heimbrock ..... 5/600
6,675,418 B1 1/2004 Armstrong
6,691,350 B2 2/2004 Weismiller
6,728,985 B2 5/2004 Brooke et al.
6,789,280 B1 9/2004 Paul
6,829,793 B2 12/2004 Brooke et al.
6,860,281 B1 3/2005 Clift
6,961,972 B2 11/2005 Pendell et al.
7,018,157 B2 * 3/2006 Gallant et al. ..... 414/495
7,020,920 B2 4/2006 Armstrong
7,032,265 B2 4/2006 Miller
7,039,971 B2 5/2006 Sebastien
7,150,058 B2 12/2006 Rabska et al.
D535,544 S 1/2007 DeBraal et al.
7,234,182 B2 6/2007 Miller et al.
7,412,734 B2 8/2008 Stryker et al.
7,419,019 B1 * 9/2008 White et al. ..... 180/19.3
7,472,445 B2 1/2009 Miller
7,530,412 B2 * 5/2009 Heimbrock et al. ..... 180/65.1
7,536,738 B2 5/2009 Richards et al.
7,568,249 B1 8/2009 Kunde et al.
7,690,059 B2 * 4/2010 Lemire et al. ..... 5/600
7,712,167 B2 5/2010 Guguin et al.
7,779,493 B2 * 8/2010 Lemire et al. ..... 5/600
7,789,187 B2 * 9/2010 Zerhusen et al. ..... 180/323
7,805,782 B2 10/2010 Hakamiun et al.
7,805,784 B2 * 10/2010 Lemire et al. ..... 5/611
7,805,789 B1 10/2010 Dean
7,814,588 B2 10/2010 Guguin et al.
7,882,582 B2 * 2/2011 Kappeler et al. ..... 5/600
7,886,377 B2 * 2/2011 Hamberg et al. ..... 5/86.1
7,962,981 B2 * 6/2011 Lemire et al. ..... 5/616
7,971,291 B2 7/2011 Stryker et al.
8,240,410 B2 * 8/2012 Heimbrock et al. ..... 180/65.1
8,260,517 B2 * 9/2012 Bhai ..... 701/70
8,397,846 B2 * 3/2013 Heimbrock et al. ..... 180/65.1
8,474,073 B2 * 7/2013 Hamberg et al. ..... 5/600
8,701,229 B2 * 4/2014 Lemire et al. ..... 5/510
8,756,726 B2 * 6/2014 Hamberg et al. ..... 5/86.1
8,757,308 B2 * 6/2014 Bhai et al. ..... 180/65.285
8,781,677 B2 * 7/2014 Roberts et al. ..... 701/36
2001/0027578 A1 10/2001 Brook et al.
2002/0078502 A1 6/2002 Baker
2002/0095728 A1 7/2002 Weismiller
2003/0024048 A1 2/2003 Heimbrock
2003/0056293 A1 3/2003 Brooke et al.
2003/0079288 A1 * 5/2003 Cook et al. ..... 5/611
2003/0167568 A1 9/2003 Brooke
2004/0168254 A1 9/2004 Rabska et al.
2005/0120485 A1 6/2005 Sebastien
2006/0085914 A1 4/2006 Peterson et al.
2006/0090260 A1 5/2006 Stryker et al.
2006/0130238 A1 6/2006 Smith
2006/0130239 A1 6/2006 Smith
2006/0195984 A1 9/2006 Hakamiun et al.
2007/0151032 A1 7/2007 Heavrin
2007/0241529 A1 * 10/2007 Stroh et al. ..... 280/202
2008/0201851 A1 * 8/2008 Menkedick et al. ..... 5/611
2009/0007332 A1 1/2009 Wu et al.
2009/0007333 A1 1/2009 Guguin et al.
2009/0007334 A1 1/2009 Stryker et al.

(56) References Cited

U.S. PATENT DOCUMENTS

| | | | | |
|---|---|---|---|---|
| 2009/0044334 | A1* | 2/2009 | Parsell et al. | 5/424 |
| 2009/0229049 | A1 | 9/2009 | Heimbrock et al. | |
| 2010/0242176 | A1 | 9/2010 | Newkirk et al. | |
| 2011/0185507 | A1 | 8/2011 | Abernathey et al. | |
| 2011/0231996 | A1* | 9/2011 | Lemire et al. | 5/613 |
| 2011/0296607 | A1* | 12/2011 | Stadlthanner et al. | 5/11 |
| 2012/0023665 | A1 | 2/2012 | Heimbrock | |
| 2012/0023666 | A1 | 2/2012 | Heimbrock et al. | |
| 2012/0054961 | A1 | 3/2012 | Heimbrock et al. | |
| 2012/0084922 | A1 | 4/2012 | Turner | |
| 2012/0102643 | A1 | 5/2012 | Turner et al. | |
| 2012/0110735 | A1 | 5/2012 | Andrienko et al. | |
| 2013/0091631 | A1* | 4/2013 | Hayes et al. | 5/600 |
| 2013/0145550 | A1* | 6/2013 | Roussy et al. | 5/617 |
| 2013/0200579 | A1* | 8/2013 | Abernethy et al. | 280/6.15 |
| 2013/0253291 | A1* | 9/2013 | Dixon et al. | 600/323 |
| 2013/0318720 | A1* | 12/2013 | Connell et al. | 5/611 |

FOREIGN PATENT DOCUMENTS

| | | | |
|---|---|---|---|
| WO | 8202832 | A1 | 9/1982 |
| WO | 0147340 | A2 | 7/2001 |
| WO | 03015686 | A1 | 2/2003 |
| WO | 03032777 | A1 | 4/2003 |
| WO | 2006025245 | A1 | 3/2006 |
| WO | 2006058506 | A1 | 6/2006 |

* cited by examiner

PATIENT SUPPORT APPARATUS HAVING MOVABLE HANDLES

CROSS-REFERENCE TO RELATED APPLICATIONS

The present application claims the benefit, under 35 U.S.C. §119(e), of U.S. Provisional Application No. 61/737944, which was filed Dec. 17, 2012, and which is hereby incorporated by reference herein in its entirety.

BACKGROUND

The present disclosure is related to patient supports, and in particular to patient supports with handles. More specifically, the present disclosure is related to a stretcher including handles for use by a caregiver moving the stretcher from one place to another. However, the present disclosure may also be applicable to other types of patient supports, such as hospital beds, wheel chairs, surgical tables, x-ray tables, and the like.

Stretchers are typically used to support patients being moved from one place to another often within a healthcare facility like a hospital or nursing home. Some stretchers include handles designed to be gripped by a caregiver pushing the stretcher from place to place. Such handles may be located at a head end of the stretcher and may be positioned at a fixed height. Sometimes, the height of the handles included in a stretcher requires short or tall caregivers to assume an uncomfortable or inefficient position while pushing the stretcher.

SUMMARY

The present application discloses one or more of the features recited in the appended claims and/or the following features which, alone or in any combination, may comprise patentable subject matter:

According to the present disclosure, a patient support apparatus may include a rolling base, and a push handle unit. The rolling base may include a lower frame, an upper frame, and a lift system. The lower frame may have head-end casters and foot-end casters. The upper frame may include a head end and a foot end. The upper frame may be supported above the lower frame. The lift system may be coupled to the lower frame and to the upper frame to move the upper frame upwardly and downwardly relative to the lower frame. The push handle unit may be coupled to the head end of the upper frame for movement with the upper frame.

In some embodiments, the patient support apparatus may include a control system. The control system may include an input unit and a controller. The controller may be coupled to the input unit and the lift system. The controller may be configured to receive a caregiver parameter from the input unit, to determine caregiver height based on the caregiver parameter from the input unit, and to move the upper frame upwardly or downwardly relative to the lower frame to a push position corresponding to the determined caregiver height so that the push handle unit is positioned for ergonomic use by the caregiver.

In some embodiments, the input unit may include a sensor configured to detect distance from the sensor to the top of a caregiver. The sensor may be configured to send the distance to the controller.

In some embodiments, the input unit may include a RFID reader coupled to the controller. The RFID reader may be configured to detect a caregiver identifier from a caregiver RFID tag and to send the caregiver identifier to the controller.

The controller may be configured to determine caregiver height based on the caregiver identifier.

In some embodiments, the input unit may include a graphical user interface coupled to the controller. The graphical user interface may be configured to receive a caregiver identifier from a caregiver. The controller may be configured to determine caregiver height based on the caregiver identifier.

In some embodiments, the push handle unit may include a grip and a user input coupled to the grip. The user input may be coupled to the controller and the controller may be configured to move the upper frame upwardly and downwardly in response to receiving requests from the user input.

In some embodiments, the lower frame may include a brake system coupled to the head-end casters and the foot-end casters. The brake system may be moveable between an engaged position, arranged to block rotation of the head-end casters and the foot end casters, and a disengaged position, arranged to allow rotation of the head-end casters and the foot-end casters. The controller may be configured to determine caregiver height, to move the upper frame to the push position, and to move the brake system from the engaged position to the disengaged position in response to receiving a request from the user input.

In some embodiments, the lower frame may include a brake system coupled to the head-end casters and the foot-end casters. The brake system may be moveable between an engaged position, arranged to block rotation of the head-end casters and the foot end casters, and a disengaged position, arranged to allow rotation of the head-end casters and the foot-end casters. The controller may be coupled to the brake system and may be configured to move the brake system from the engaged position to the disengaged position after the controller moves the upper frame to the push position.

According to the present disclosure, a patient support apparatus may include a lower frame, an upper frame, and a push handle unit. The lower frame may include head-end casters and foot-end casters. The upper frame may include a head end and a foot end. The upper frame may be supported above the lower frame. The push handle unit may include a grip and a handle motion unit coupled to the grip and to the upper frame to move the grip upwardly and downwardly relative to the upper frame.

In some embodiments, the patient support apparatus may include a controller coupled to the push handle unit. The controller may be configured to determine caregiver height and to move the push handle unit upwardly or downwardly relative to the upper frame to a push position corresponding to the determined caregiver height so that the push handle unit is positioned for ergonomic use by the caregiver.

In some embodiments, the patient support apparatus may include a sensor coupled to the controller. The sensor may be configured to detect caregiver height and to send the caregiver height to the controller.

In some embodiments, the patient support apparatus may include a RFID reader coupled to the controller. The RFID reader may be configured to detect a caregiver identifier from a caregiver RFID tag and to send the caregiver identifier to the controller. The controller may be configured to determine caregiver height based on the caregiver identifier.

In some embodiments, the patient support apparatus may include a graphical user interface coupled to the controller. The graphical user interface may be configured to receive a caregiver identifier from a caregiver. The controller may be configured to determine caregiver height based on the caregiver identifier.

In some embodiments, the push handle unit may include a user input coupled to the grip and to the motion unit. The motion unit may be configured to move the grip relative to the upper frame in response to a caregiver input received by the user input.

In some embodiments, the handle motion unit may be coupled to grip and to the upper frame to move the grip about a pivot axis relative to the upper frame. The pivot axis may be arranged to extend along the head end of the upper frame. The push handle unit may include a user input coupled to the grip and to the motion unit. The motion unit may be configured to move the grip upwardly relative to the upper frame in response to caregiver inputs received by the user input.

In some embodiments, the lower frame may include a brake system coupled to the head-end casters and the foot-end casters. The brake system may be configured to brake the head-end casters and the foot-end casters when the grip is moving relative to the upper frame.

According to the present disclosure, a patient support apparatus may include a lower frame, an upper frame, and a siderail. The lower frame may include head-end casters and foot-end casters. The upper frame may include a head end and a foot end. The upper frame may be supported above the lower frame. The siderail may include a barrier and a rail handle. The barrier may be coupled to the upper frame. The rail handle may be coupled to the barrier at the head end of the upper frame to move about a handle axis from a stowed position to a deployed position. In the stowed position, the rail handle may extend along the barrier. In the deployed position, the rail handle may extend perpendicular to the barrier away from the upper frame to allow a caregiver to push from a side of the barrier near the head end of the upper frame.

In some embodiments, the siderail may include a lock coupled to the barrier. The lock may be configured to selectively block the rail handle from moving away from the deployed position. The handle axis may extend from the head end to the foot end of the upper frame.

In some embodiments, the barrier may include a first leg pivotably coupled to the upper frame, a second leg pivotably coupled to the upper frame, and a top rail pivotably coupled to the first leg and the second leg. The barrier may be movable from a lowered position, arranged below a top surface of the upper frame, to a raised position, arranged to extend above the top surface of the upper frame.

In some embodiments, the rail handle may be coupled to the top rail of the barrier. The rail handle may include a collar coupled to the top rail of the barrier to pivot about the top rail and a grip extending outwardly from the collar.

In some embodiments, the rail handle may lie in a footprint of the barrier when the push handle unit is in the stowed position. In addition, the push handle unit may extend outside the footprint of the barrier when the push handle unit is in the deployed position.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1A:
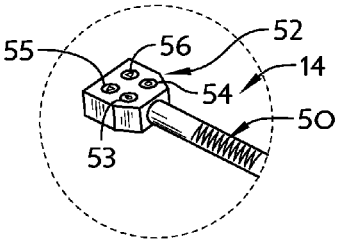
FIG. 1A is a detail perspective view of a portion of the push handle unit showing that the push handle unit includes a grip and a user input.
Figure 1B:
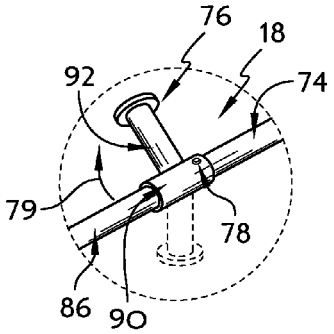
FIG. 1B is a detail perspective view of a portion of the siderail showing that the siderail includes a barrier and the side handle, and showing the side handle moves from a stowed position to a deployed position relative to the barrier.
Figure 1:
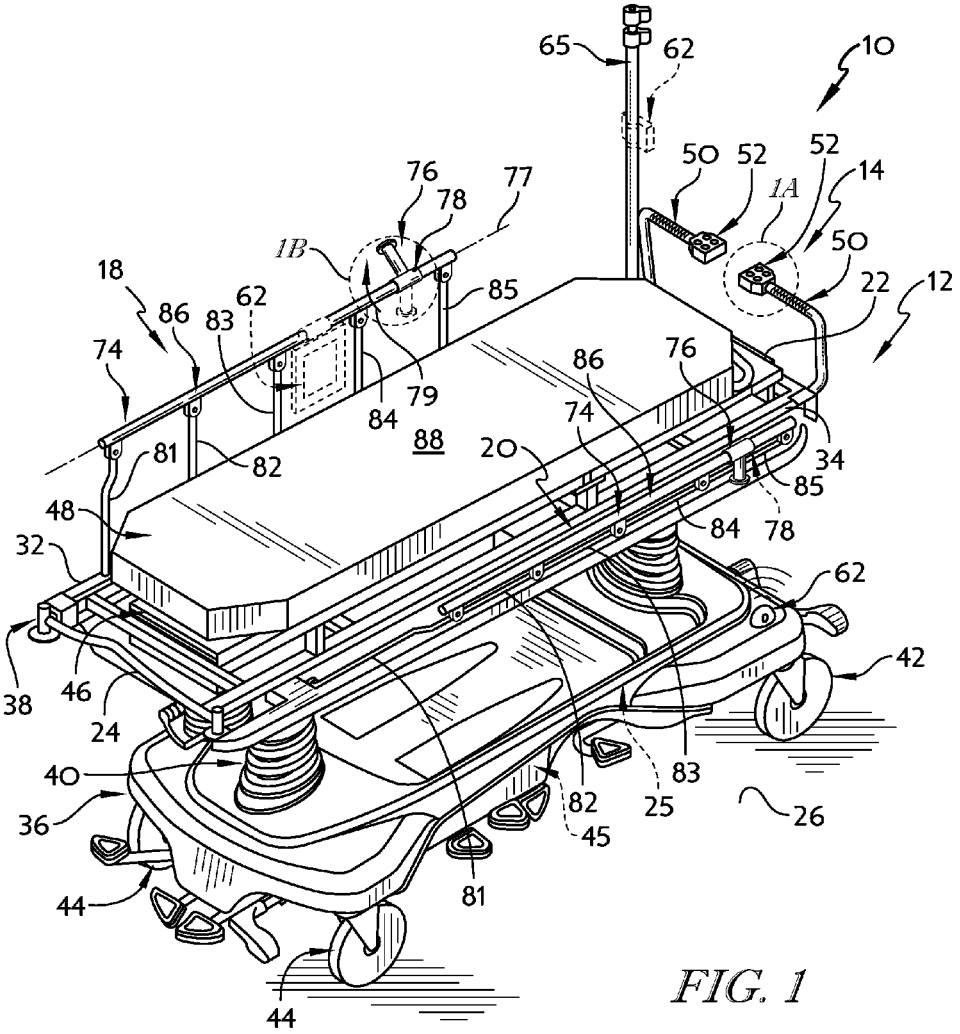
FIG. 1 is perspective view of an illustrative stretcher including a rolling base, a push handle unit coupled to the rolling base for movement upwardly and downwardly to provide an ergonomic hand hold for a user pushing the stretcher from a head end, and a siderail coupled to a side of the rolling base including a side handle movable to a deployed position to provide an ergonomic hand hold for a user pushing the stretcher from a side.

A patient support apparatus is illustratively embodied as a stretcher 10 for moving patients from one location to another as shown in FIG. 1. The stretcher 10 illustratively includes a rolling base 12, a push handle unit 14, and a control system 25 as shown in FIG. 1. The rolling base 12 has a head end 22 and a foot end 24 and is configured to roll along a floor 26 when pushed by a caregiver. The push handle unit 14 is coupled to the head end 22 of the rolling base 12 and provides a hand hold for a caregiver pushing the rolling base 12 from along the head end 22 of the rolling base 12. The control system 25 is coupled to the rolling base 12 and the push handle unit 14. The control system 25 is configured to manually or automatically adjust the height of the push handle unit 14 to a push position corresponding to a caregiver's height so that the push handle unit 14 is positioned for ergonomic use by the caregiver when the stretcher 10 is pushed from place to place.

The stretcher 10 also includes a right siderail 18 and a left siderail 20 as shown in FIG. 1. The siderails 18, 20 are coupled to the rolling base 12 and extend between the head end 22 and the foot end 24 of the rolling base 12 along sides 32, 34 of the rolling base 12. Each siderail 18, 20 includes a deployable side handle 76 that provides a hand hold for a caregiver pushing the rolling base 12 from along the sides 32, 34 of the rolling base 12 as shown in FIG. 1B.

The rolling base 12 illustratively includes a lower frame 36, an upper frame 38, and a lift system 40 as shown, for example, in FIG. 1. The lower frame 36 is configured to roll along the floor 26 and includes a pedestal 41, head-end casters 42, foot-end casters 44, and a brake system 45 coupled to the casters 42, 44 to selectively brake the casters 42, 44 from rolling along the floor 26. The upper frame 38 is supported above the lower frame 36 and includes a deck 46 and a support surface 48 mounted on the deck 46. The lift system 40 is coupled to the lower frame 36 and to the upper frame 38 and is configured to move the upper frame 38 upwardly and downwardly relative to the lower frame 36.

The push handle unit 14 is coupled to the upper frame 38 for movement with the upper frame 38 relative to the lower frame 36 as shown, for example, in FIG. 1. The push handle unit 14 includes a grip 50 and a user input 52. The grip 50 is coupled to the head end 22 of the upper frame 38 and is sized to be held by a caregiver pushing the rolling base 12. The user input 52 is coupled to the grip 50 and is arranged to be operated by a caregiver holding the grip 50. In the illustrative embodiment, the user input 52 includes push buttons 53, 54, 55, 56 as shown in FIG. 1A; however, in other embodiments, the user input 52 may include pivot switches, roll switches, or other suitable inputs.

Figure 2:
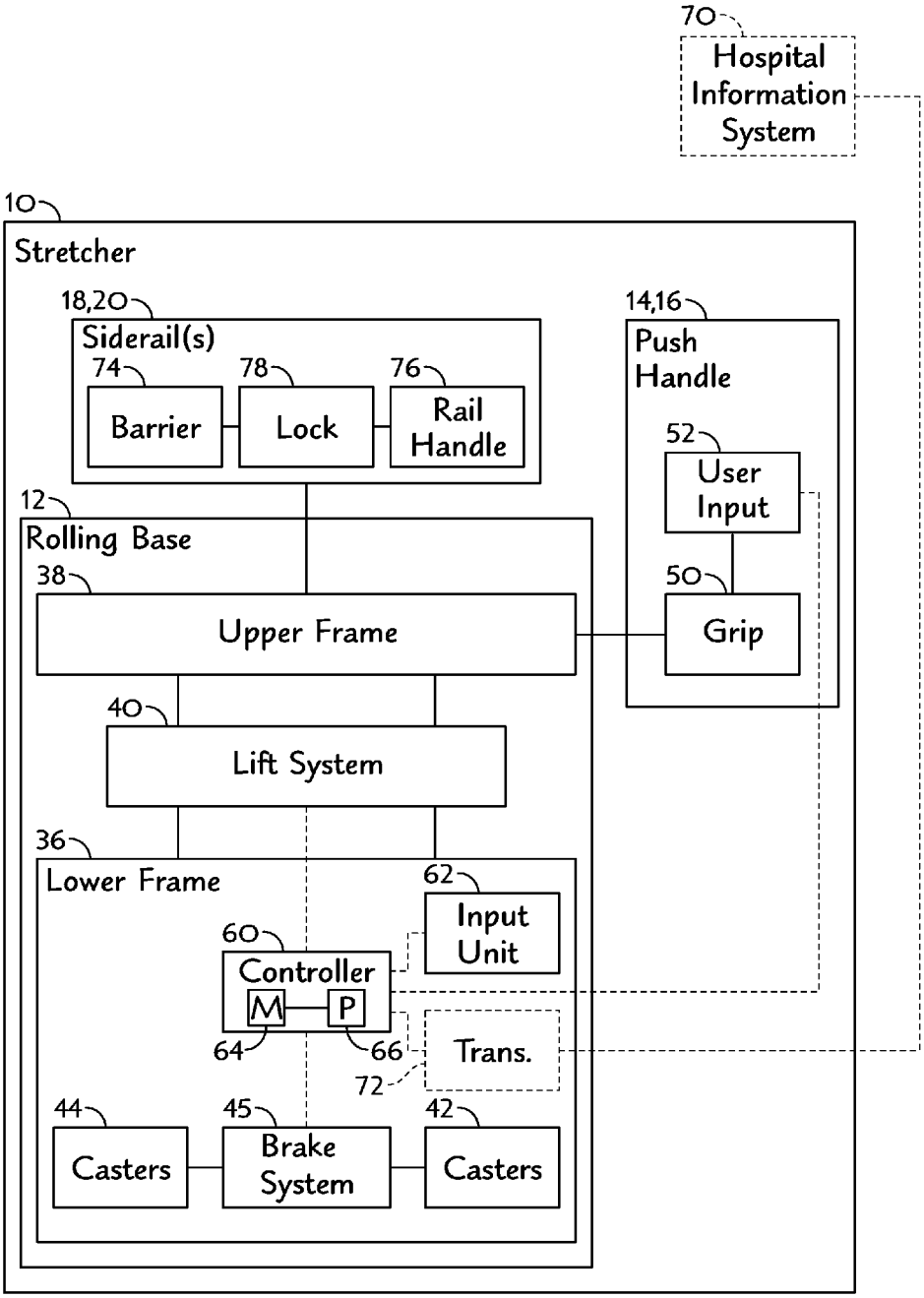
FIG. 2 is a diagrammatic view of the stretcher of FIG. 1 showing that the stretcher includes a lower frame and an upper frame connected by a lift system configured to raise and lower the upper frame along with the push handle unit.

The control system 25 illustratively includes a controller 60 and an input unit 62 coupled the lower frame 36 and to the controller 60 as shown in FIG. 2. The controller 60 is illustratively coupled to the lift system 40, the brake system 45, and the user input 52 as shown in FIG. 2. The input unit 62 is illustratively a sensor configured to detect the distance from the input unit 62 to the top of a caregiver standing along the head end 22 of the rolling base 12. The input unit 62 may be a sonic sensor, a visual sensor, or another suitable sensor.

The controller 60 includes a memory 64 containing instructions and a processor 66 coupled to the memory 64 to perform the instructions stored in the memory 64 as shown in FIG. 2. In the illustrative embodiment, the memory 64 contains instructions corresponding to the processes described herein.

Figure 3:
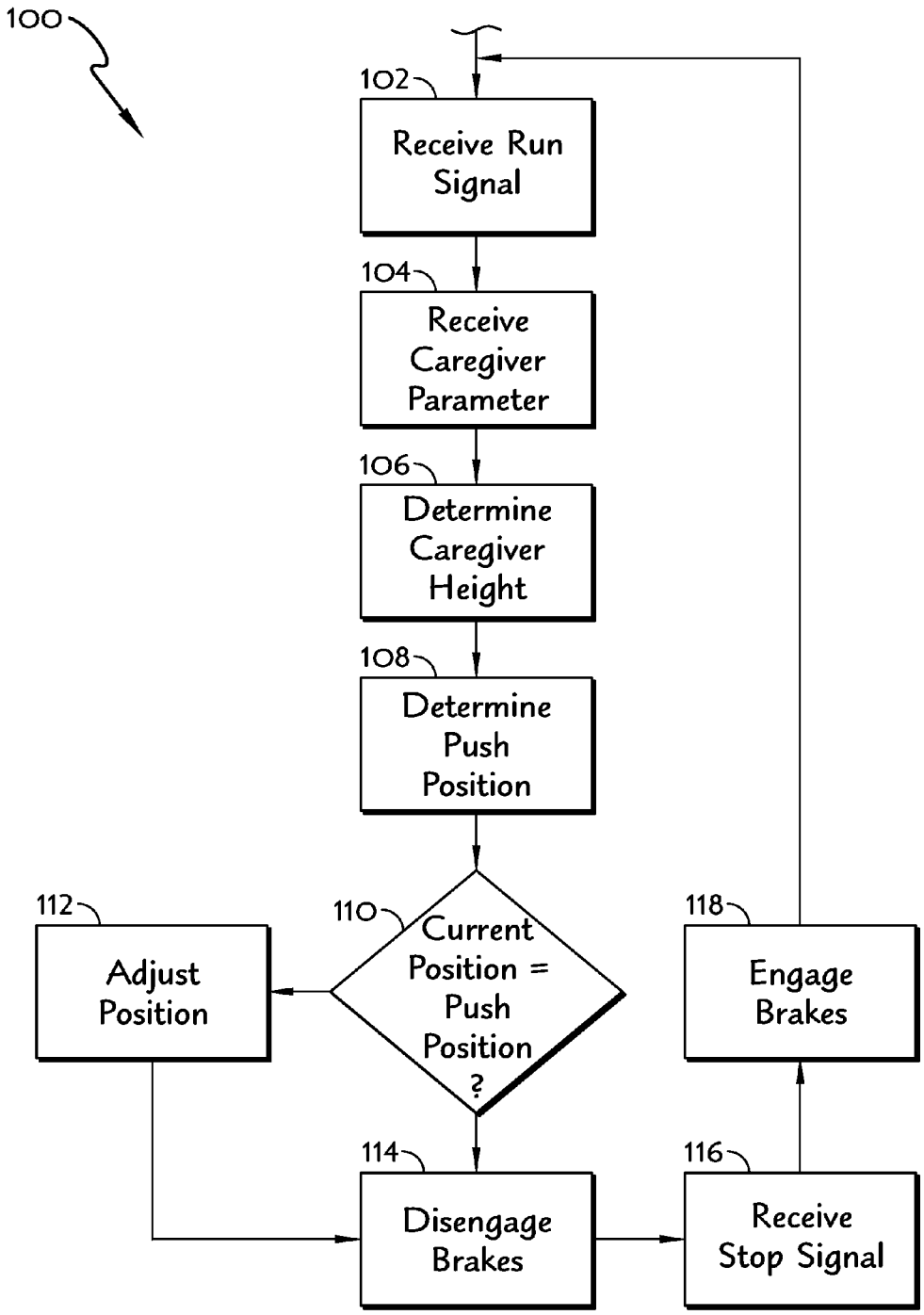
FIG. 3 is a diagrammatic view of a process performed by the stretcher of FIGS. 1 and 2.

In operation, the controller 60 performs a process 100 to adjust the height of the push handle unit 14 as shown in FIG. 3. In a step 102 of the process 100, the controller 60 receives a run signal from the user input 52 in response to a caregiver pressing a run button 53 included in the user input 52. In an alternative embodiment, the run signal may be received from a sensor that detects a force is applied to the grip 50 by a caregiver pushing the grip 50. Next, in a step 104, the controller 60 receives a caregiver parameter from the input unit 62. In the illustrative embodiment, the caregiver parameter is distance from the input unit 62 to the top of a caregiver standing along the head end 22 of the rolling base 12. Then, in a step 106, the controller 60 determines a height of the caregiver based on the caregiver parameter. The controller 60 then proceeds to a step 108 in which the controller 60 determines an ergonomic push position of the upper frame 38 and push handle unit 14 corresponding to the caregiver height.

Then, in a decision step 110, the controller 60 compares the current position of the upper frame 38 and the grip 50 to the determined push position. If the current position does not match the push position, the controller 60 checks to be sure that the brake system 45 is engaged and the casters 42, 44 are braked. Then the controller 60 advances to a step 112 and operates the lift system 40 to move the upper frame 38 and the push handle unit 14 to the push position. Once the current position matches the push position, the controller 60 disengages the brake system 45 to unbrake the casters 42, 44. If the current position matches the push position without requiring adjustment, then the controller 60 advances directly to step 114 and disengages the brake system 45 to unbrake the casters 42, 44. In a step 116, the controller 60 receives a stop signal from the user input 52 in response to a caregiver pressing a stop button 54 included in the user input 52. In an alternative embodiment, the stop signal may be received from a sensor that detects removal of a force applied to the grip 50 by a caregiver pushing the grip 50. Then in a step 118, the controller engages the brake system 45 so that the casters 42, 44 are braked.

The controller 60 is also configured to raise and lower the upper frame 38 and the push handle unit 14 in response to receipt of lift and lower signals received from the user input 52. Specifically, the controller 60 is configured to raise the upper frame 38 and the push handle unit 14 in response to a caregiver pressing a lift button 55 and to lower the upper frame 38 and push handle unit 14 in response to a caregiver pressing a lower button 56. Thus, a caregiver can manually adjust the height of the push handle unit 14.

In an alternative embodiment, the input unit 62 may be a badge reader, such as an RFID reader, a bar code reader, or the like as suggested in FIG. 1. The badge reader is illustratively mounted to the upper frame 38 along an IV pole 65 to position the badge reader for reading caregiver ID cards. In such an embodiment, the caregiver parameter received by controller 60 in step 104 of process 100 is a caregiver identifier that may include employee name, employee number, employee height or the like. In some such embodiments, to determine caregiver height in step 106 of process 100, the controller 60 may match the caregiver identifier to caregiver height in a look-up table stored in the memory 64 or in a hospital information system 70 accessed through an optionally included transceiver 72.

In another alternative embodiment, the input unit 62 may be a user interface, such as a touch-sensitive display, a keypad, or the like as suggested in FIG. 1. The user interface is illustratively mounted to the siderail 18 to be accessible to a caregiver. In such an embodiment, the caregiver parameter received by controller 60 in step 104 of process 100 is a caregiver identifier that may include employee name, employee number, employee height or the like entered by a caregiver into the user interface. In some such embodiments, to determine caregiver height in step 106 of process 100, the controller 60 may match the caregiver identifier to caregiver height in a look-up table stored in the memory 64 or in a hospital information system 70 accessed through an optionally included transceiver 72.

Referring back to FIG. 1, the siderails 18, 20 each illustratively include a barrier 74, a rail handle 76, and a lock 78. The barrier 74 is coupled to the upper frame 38 and is movable between a lowered position (shown in siderail 20) and a raised position (shown in siderail 18). The rail handle 76 is coupled to the barrier 74 at the head end 22 of the rolling base 12 for movement about a rail-handle pivot axis 77. The rail handle 76 moves from a stowed position (shown in phantom) to a deployed position (shown in solid) as suggested by arrow 79 in FIG. 1. The lock 78 is illustratively a spring-loaded pin and hole combination configured to selectively block rail handle 76 from movement away from the deployed position. In the deployed position, the rail handle provides a hand hold to allow a caregiver to push the rolling base 12 from the sides 32, 34 of the rolling base 12 as suggested in FIG. 1.

Each barrier 74 includes a plurality of legs 81, 82, 83, 84, 85 and a top rail 86 as shown, for example, in FIG. 1. Each leg 81, 82, 83, 84, 85 is pivotably coupled to the upper frame 38 for movement about axes that are orthogonal to the rail-handle pivot axis 77. Each leg 81, 82, 83, 84, 85 is also coupled to a corresponding top rail 86 for movement about axes that are orthogonal to the rail-handle pivot axis 77. The legs 81, 82, 83, 84, 85 pivot relative to the upper frame 38 and the top rail 86 to move from the lowered position to the raised position. The top rail 86 illustratively has a round cross-section that extends along the rail-handle pivot axis 77 to provide a bearing surface for movement of the rail handle 76 relative to the top rail 86. In the lowered position, the barrier 74 is arranged below a top surface 88 of the upper frame 38 (as shown in siderail 20). In the raised position, the barrier 74 is arranged to extend above the top surface 88 of the upper frame 38 (as shown in siderail 18).

The rail handle 76 illustratively includes a collar 90 and a grip 92 that extends from the collar 90 as shown in FIG. 1B. The collar 90 is coupled to the top rail 86 for rotative bearing engagement with the top rail 86 so that the rail handle 76 can rotate about the top rail 86. The grip 92 is sized to be held in a caregiver's hand. In the stowed position, the rail handle 76 extends downwardly from the top rail 86, along the barrier 74, and is received in a footprint of the barrier 74 when viewed from above as suggested in phantom in FIG. 1B. In the deployed position, the rail handle 76 extends outwardly from the top rail 86, orthogonal to the barrier 74, and extends out of the footprint of the barrier 74 when viewed from above as suggested in FIG. 1B.

Figure 4:
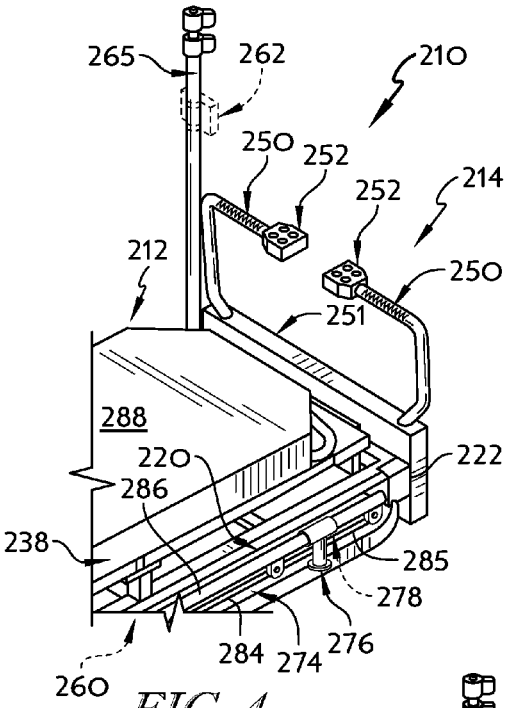
FIG. 4 is a partial perspective view of another stretcher including a rolling base and a push handle unit coupled to the head end of the rolling base showing that the push handle unit includes a grip, a user input coupled to the grip, and a motion unit coupled between the grip and the rolling base.
Figure 5:
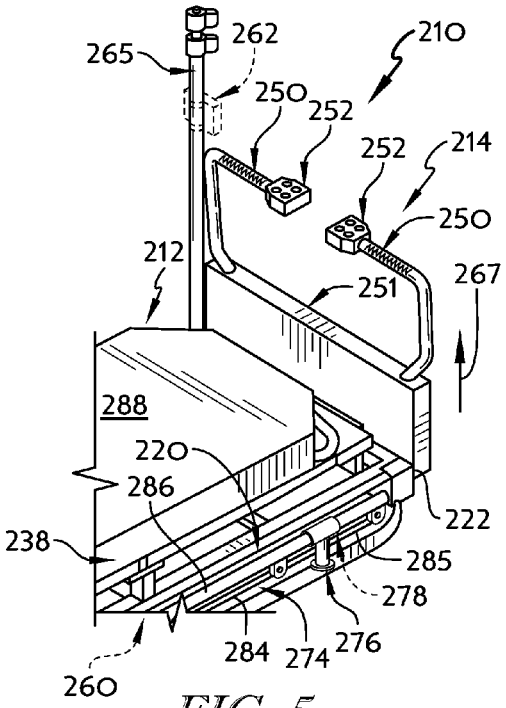
FIG. 5 is a view similar to FIG. 4 showing that the motion unit is configured to move the grip upwardly relative to the rolling base.
Figure 6:
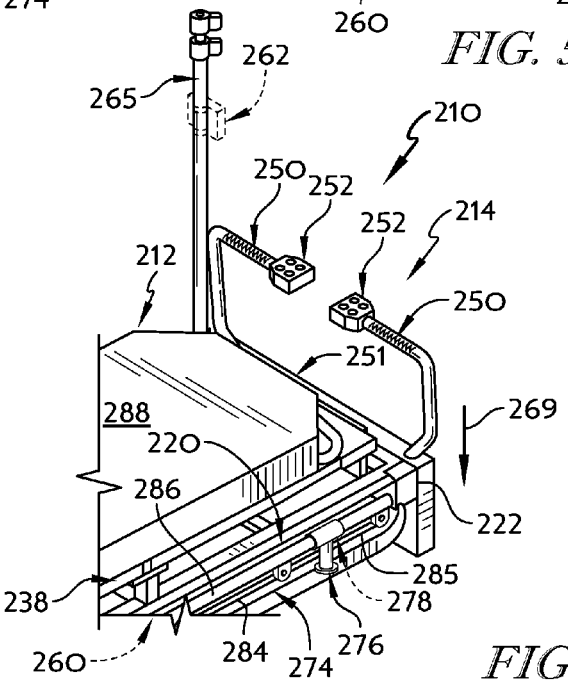
FIG. 6 is a view similar to FIGS. 4 and 5 showing that the motion unit is configured to move the grip downwardly relative to the rolling base.

Turning now to FIGS. 4-6, another exemplary stretcher 210 is shown. The stretcher 210 is substantially similar to the stretcher 10 shown in FIGS. 1-3 and described herein. Accordingly, similar reference numbers in the 200 series indicate features that are common between the stretcher 10 and the stretcher 210. The description of the stretcher 10 is hereby incorporated by reference to apply to the stretcher 210, except in instances when it conflicts with the specific description and drawings of the stretcher 210.

Unlike the stretcher 10, the stretcher 210 has push handle unit 214 that each include a motion unit 251 in addition to a grip 250 and a user input 252 as shown in FIGS. 4-6. Motion unit 251 is coupled between the upper frame 238 of rolling base 212 and the grips 250 of the push handle unit 214 to enable movement of the grips 250 upwardly and downwardly without moving the upper frame 238 upwardly and downwardly as suggested by arrows 267, 269 in FIGS. 5 and 6. Motion unit 251 is also coupled to controller 260 so that movement of the grips 250 may be electrically controlled. Thus, the push position of the grip 50 included in the push handle unit 214 can be adjusted upwardly or downwardly to correspond to a caregiver height without changing the position of the upper frame 238.

In operation, the stretcher 210 is configured to perform the process 100 except that the push position is correlated to the height of the grip 250. In other words, when the stretcher 210 performs the process 100, step 112 of adjusting position is carried out by controller 260 operating the motion unit 251 to move the grip 250 upwardly or downwardly until the current position of the grip 250 matches the determined push position.

Figure 7:
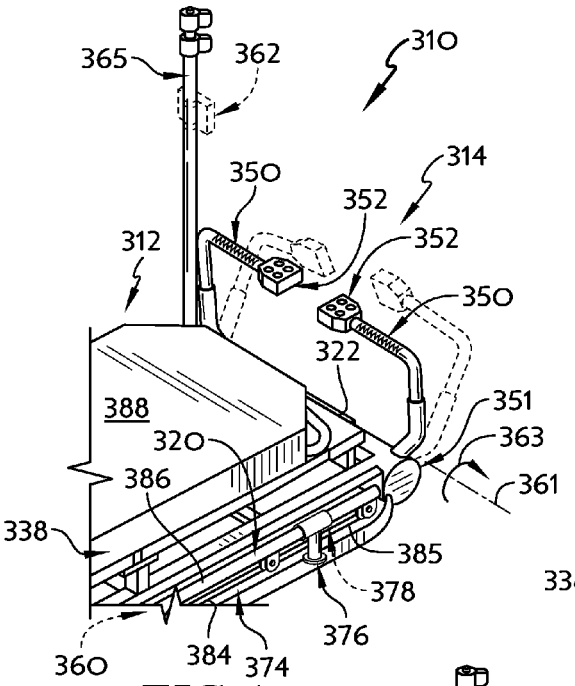
FIG. 7 is a partial perspective view of yet another stretcher including a rolling base and a push handle unit coupled to the head end of the rolling base showing that the push handle unit includes a grip, a user input coupled to the grip, and a motion unit coupled between the grip and the rolling base configured to pivot outwardly relative to the rolling base.
Figure 8:
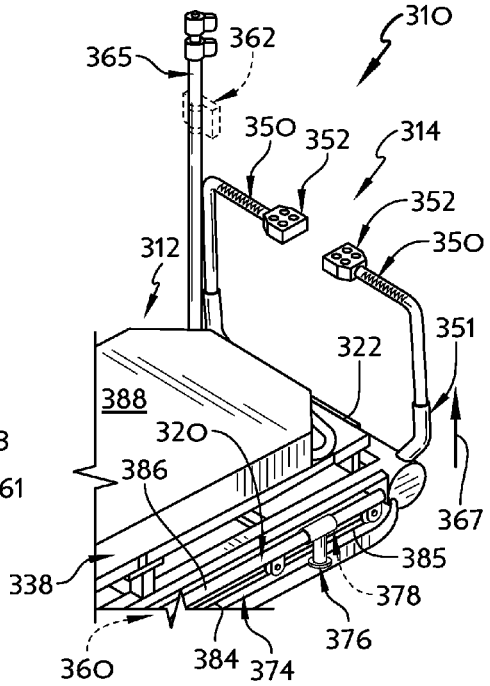
FIG. 8 is a view similar to FIG. 7 showing that the motion unit is configured to move the grip upwardly relative to the rolling base.
Figure 9:
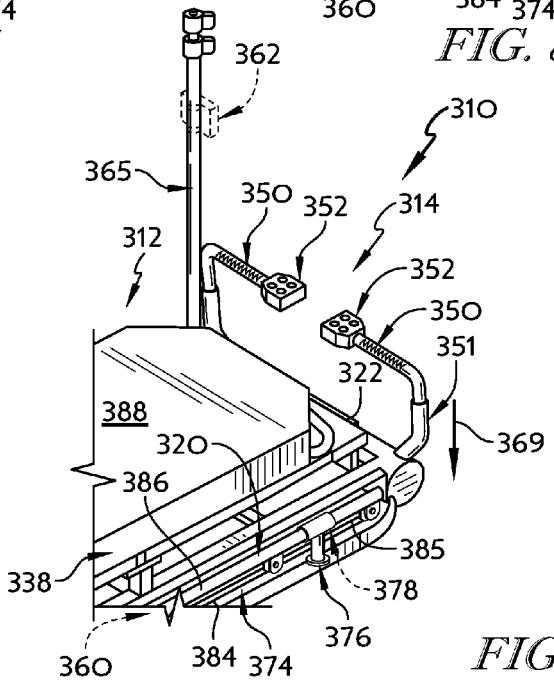
FIG. 9 is a view similar to FIGS. 7 and 8 showing that the motion unit is configured to move the grip downwardly relative to the rolling base.

Turning now to FIGS. 7-9, another exemplary stretcher 310 is shown. The stretcher 310 is substantially similar to the stretcher 10 shown in FIGS. 1-3 and described herein. Accordingly, similar reference numbers in the 300 series indicate features that are common between the stretcher 10 and the stretcher 310. The description of the stretcher 10 is hereby incorporated by reference to apply to the stretcher 310, except in instances when it conflicts with the specific description and drawings of the stretcher 310.

Unlike the stretcher 10, the stretcher 310 has push handle unit 214 that include a motion unit 351 in addition to grips 350 and a user inputs 352 as shown in FIGS. 7-9. Motion unit 351 is coupled between the upper frame 338 of rolling base 312 and the grips 350 of the handles 314 to enable movement of the grips 350 upwardly and downwardly without moving the upper frame 338 upwardly and downwardly. More particularly, grips 350 are coupled to motion unit 351 to telescope inwardly and outwardly from motion unit 351 to adjust the height of the grips 350 as suggested by arrows 367, 369 in FIGS. 8 and 9.

Motion unit 351 is also coupled to upper frame 338 for movement about a pivot axis 361 extending along the head end 322 of the rolling base 312 as suggested by arrow 363 in FIG. 7. When motion unit 351 rotates relative to rolling base 312, the grips 350 are moved outwardly and inwardly relative to the rolling base 312. By adjusting the position of the push handle unit inwardly and outwardly, the push handle unit 214 may be able to accommodate the longer or shorter strides of taller or shorter caregivers pushing the stretcher 10.

Motion unit 351 is coupled to controller 360 so that movement of the grips 350 may be electrically controlled. Thus, the push position of the handles 314 can be adjusted upwardly, downwardly, inwardly, and outwardly to correspond to a caregiver height without changing the position of the upper frame 338.

In operation, the stretcher 310 is configured to perform the process 100 except that the push position is correlated to the height of the grips 350 and spacing of the grips 350 from the rolling base 312. In other words, when the stretcher 310 performs the process 100, step 108 of determining the push position includes determining both height of the grips 350 and spacing of the grips 350 from the rolling base 312 to correspond to a caregiver height. Also, step 112 of adjusting position is carried out by controller 360 operating the motion unit 351 to move the grips 350 upwardly or downwardly and inwardly or outwardly until the current position of the grips 350 matches the determined push position.

Although certain illustrative embodiments have been described in detail above, variations and modifications exist within the scope and spirit of this disclosure as described and as defined in the following claims.

The invention claimed is:

1. A patient support apparatus comprising a rolling base including a lower frame having head-end casters and foot-end casters, an upper frame including a head end and a foot end, the upper frame supported above the lower frame, and a lift system coupled to the lower frame and to the upper frame, the lift system configured to move the upper frame upwardly and downwardly relative to the lower frame, a push handle unit coupled to the head end of the upper frame for movement with the upper frame, and a control system including an input unit and a controller coupled to the input unit and the lift system, the controller configured to receive a caregiver parameter from the input unit, to determine caregiver height based on the caregiver parameter from the input unit, and to move the upper frame upwardly or downwardly relative to the lower frame to a push position corresponding to the determined caregiver height so that the push handle unit is positioned for ergonomic use by the caregiver in response to receipt of a run signal associated with movement of the patient support apparatus along a floor.

2. The patient support apparatus of claim 1, wherein the input unit includes a sensor configured to detect distance from the sensor to the top of a caregiver and to send the distance to the controller.

3. The patient support apparatus of claim 1, wherein the input unit includes a RFID reader coupled to the controller, the RFID reader configured to detect a caregiver identifier from a caregiver RFID tag and to send the caregiver identifier to the controller.

4. The patient support apparatus of claim 3, wherein the controller is configured to determine caregiver height based on the caregiver identifier.

5. The patient support apparatus of claim 1, wherein the input unit includes a graphical user interface coupled to the controller, the graphical user interface configured to receive a caregiver identifier from a caregiver.

6. The patient support apparatus of claim 5, wherein the controller is configured to determine caregiver height based on the caregiver identifier.

7. The patient support apparatus of claim 1, wherein the push handle unit includes a grip and a user input coupled to the grip.

8. The patient support apparatus of claim 7, wherein the lower frame includes a brake system coupled to the head-end casters and the foot-end casters, the brake system moveable between an engaged position, arranged to block rotation of the head-end casters and the foot end casters, and a disengaged position, arranged to allow rotation of the head-end casters and the foot-end casters, and the controller is configured to determine caregiver height, to move the upper frame to the push position, and to move the brake system from the engaged position to the disengaged position in response to receiving a request from the user input.

9. The patient support apparatus of claim 1, wherein the lower frame includes a brake system coupled to the head-end casters and the foot-end casters, the brake system moveable between an engaged position, arranged to block rotation of the head-end casters and the foot end casters, and a disengaged position, arranged to allow rotation of the head-end casters and the foot-end casters, and the controller is coupled to the brake system, and the controller is configured to move the brake system from the engaged position to the disengaged position after the controller moves the upper frame to the push position.

10. The patient support apparatus of claim 1, wherein the controller is configured to receive the run signal from a run button.

11. The patient support apparatus of claim 7, wherein the controller is configured to receive the run signal from a force applied to the grip.

12. A patient support apparatus comprising a lower frame including head-end casters and foot-end casters, an upper frame including a head end and a foot end, the upper frame supported above the lower frame, a push handle unit including a grip and a handle motion unit coupled to the grip and to the upper frame to move the grip upwardly and downwardly relative to the upper frame and a controller coupled to the push handle unit, wherein the controller is configured to determine caregiver height and to move the push handle unit upwardly or downwardly relative to the upper frame to a push position corresponding to the determined caregiver height so that the push handle unit is positioned for ergonomic use by the caregiver in response to receipt of a run signal associated with movement of the patient support apparatus along a floor.

13. The patient support apparatus of claim 12, further comprising a sensor coupled to the controller, the sensor configured to detect caregiver height and to send the caregiver height to the controller.

14. The patient support apparatus of claim 12, further comprising a RFID reader coupled to the controller, the RFID reader configured to detect a caregiver identifier from a caregiver RFID tag and to send the caregiver identifier to the controller.

15. The patient support apparatus of claim 14, wherein the controller is configured to determine caregiver height based on the caregiver identifier.

16. The patient support apparatus of claim 12, further comprising a graphical user interface coupled to the controller, the graphical user interface configured to receive a caregiver identifier from a caregiver.

17. The patient support apparatus of claim 16, wherein the controller is configured to determine caregiver height based on the caregiver identifier.

18. The patient support apparatus of claim 12, wherein the push handle unit includes a user input coupled to the grip and to the motion unit.

19. The patient support apparatus of claim 18, wherein the motion unit is configured to move the grip relative to the upper frame in response to a caregiver input received by the user input.

20. The patient support apparatus of claim 12, wherein the handle motion unit is coupled to grip and to the upper frame to move the grip about a pivot axis relative to the upper frame.

21. The patient support apparatus of claim 20, wherein the pivot axis is arranged to extend along the head end of the upper frame.

22. The patient support apparatus of claim 12, wherein the controller is configured to receive the run signal from a run button.

23. The patient support apparatus of claim 18, wherein the controller is configured to receive the run signal from a force applied to the grip.

* * * * *